US008857342B2

(12) United States Patent
Wilson et al.

(10) Patent No.: US 8,857,342 B2
(45) Date of Patent: Oct. 14, 2014

(54) NANO-ENHANCED KINETIC ENERGY PARTICLES

(75) Inventors: Dennis Eugene Wilson, Austin, TX (US); Kurt A. Schroder, Coupland, TX (US); Darrin Lee Willauer, The Woodlands, TX (US); Stephan Bless, Austin, TX (US); Rodney Thompson Russell, Austin, TX (US)

(73) Assignee: NCC Nano, LLC, Dallas, TX (US)

( * ) Notice: Subject to any disclaimer, the term of this patent is extended or adjusted under 35 U.S.C. 154(b) by 1444 days.

(21) Appl. No.: 11/813,611

(22) PCT Filed: Jan. 10, 2006

(86) PCT No.: PCT/US2006/000763

§ 371 (c)(1),
(2), (4) Date: Aug. 11, 2009

(87) PCT Pub. No.: WO2007/086830

PCT Pub. Date: Aug. 2, 2007

(65) Prior Publication Data

US 2009/0301337 A1 Dec. 10, 2009

Related U.S. Application Data

(60) Provisional application No. 60/642,705, filed on Jan. 10, 2005, provisional application No. 60/655,513, filed on Feb. 23, 2005.

(51) Int. Cl.

| | |
|---|---|
| ***F42B 12/04*** | (2006.01) |
| ***F42B 12/44*** | (2006.01) |
| ***F42B 12/74*** | (2006.01) |
| ***F42B 12/06*** | (2006.01) |

(52) U.S. Cl.
CPC ..... *F42B 12/74* (2013.01); *F42B 12/06* (2013.01)
USPC ..... 102/517; 102/364

(58) Field of Classification Search
USPC ..... 102/517, 518, 519, 520, 521, 522, 523, 102/364
See application file for complete search history.

(56) References Cited

U.S. PATENT DOCUMENTS

| | | | | |
|---|---|---|---|---|
| 4,444,112 | A * | 4/1984 | Strandli et al. | 102/364 |
| 5,097,766 | A * | 3/1992 | Campoli et al. | 102/364 |
| 5,501,155 | A * | 3/1996 | Hollis et al. | 102/529 |
| 5,515,785 | A * | 5/1996 | Zglenicki | 102/473 |
| 5,728,968 | A * | 3/1998 | Buzzett et al. | 102/364 |
| 6,546,838 | B2 * | 4/2003 | Zavitsanos et al. | 89/1.13 |
| 6,679,176 | B1 * | 1/2004 | Zavitsanos et al. | 102/364 |
| 6,691,622 | B2 * | 2/2004 | Zavitsanos et al. | 102/364 |
| 7,059,233 | B2 * | 6/2006 | Amick | 86/54 |
| 7,191,709 | B2 * | 3/2007 | Nechitailo | 102/518 |
| 7,503,261 | B2 * | 3/2009 | Burri | 102/518 |
| 7,632,364 | B1 * | 12/2009 | Jouet et al. | 149/37 |
| 8,505,427 | B2 * | 8/2013 | Wilson et al. | 89/1.13 |
| 8,568,541 | B2 * | 10/2013 | Nielson et al. | 149/19.3 |
| 2005/0199323 | A1 * | 9/2005 | Nielson et al. | 149/19.3 |
| 2008/0229963 | A1 * | 9/2008 | Nielson et al. | 102/364 |

* cited by examiner

*Primary Examiner* — James Bergin
(74) *Attorney, Agent, or Firm* — Antony P. Ng; Russell Ng PLLC

(57) ABSTRACT

The current invention relates to the fields of ballistic and kinetic energy (KE) weapons. Specifically a novel apparatus and use of nanomaterials has been developed to make significant improvements over existing weapons. By incorporating nano-scale particles as a filler material for kinetic energy weapons several advancements are realized.

3 Claims, 8 Drawing Sheets

A

501

502

B

501

502

Shot 852—Front witness plate after penetrator with inert fill.

A B

Shot 853—Front witness Plate after penetrator with MIC fill.

C D

701

701

702

702

NANO-ENHANCED KINETIC ENERGY PARTICLES

GOVERNMENT RIGHTS

This invention was made with United States Government support under Grant No. DASG60-01-C-0070 awarded by the United States Department of Defense. The Government may have certain rights in this invention.

RELATED PATENT APPLICATIONS

The present application is related to Provisional Application No. 60/642,705 (filed Jan. 10, 2005) and Provisional Application No. 60/655,513 (filed Feb. 23, 2005). The above-identified provisional applications are assigned to the Assignee of the present invention and are incorporated herein by reference.

FIELD OF THE INVENTION

The current invention relates to the fields of ballistic and kinetic energy (KE) weapons. Specifically a novel apparatus and use of powdered materials and more specifically nano-materials has been developed to make significant improvements over existing weapons. By incorporating powders and in more specifically nano-scale particles as a filler material for kinetic energy weapons several advancements are realized. The first benefit is enhanced lethality against both soft and hard targets. Lethality is taken to apply to both the target armor and behind armor effects. The second benefit is to produce an insensitive munition. This can be accomplished by using precision-engineered nano-scale materials, such as metal oxides that it is believed will evolve gas by vaporization, desorption, dissociation, or otherwise assist in gas expansion at temperatures that are much lower than the corresponding vaporization temperature of the bulk solid. These nanomaterials can have a wide range of mass-density (from 4 to 13 g/cc, in some instances, optimally greater than 7 g/cc and, more optimally, greater than 9 g/cc) and can be tailored to be effective over a range of temperatures and pressures that correspond to different impact velocities. In addition, they can be tailored to vaporize and/or create gas expansion during the target penetration process so as to effectively couple the energy to the target and act similar to an explosive. Another understood benefit is the release of oxygen from the oxide to further react with the high-temperature target and penetrator material. In effect, the projectile can bring the oxidizer to the target, which acts as the fuel. The impact process initiates mixing followed by a highly exothermic reaction. In this sense, the material behaves as a reactive material after impact, but not necessarily before.

Larger powders, in the micron range, have also been used effectively. It is believed that upon impact, that the complex interaction associated with the impact shock, powder porosity and particle interfaces allows the larger material to behave in a similar manner as the nano-materials. Hence dramatic effects can also been seen with the larger particles.

BACKGROUND OF THE INVENTION

Current KE penetrators are long-rod projectiles (0.5-2 m) that are fired at high velocities, typically 1.6% m/s to 3.0 km/s by the use of a sabot. These "arrow-like" projectiles are machined from high mass-density materials, such as but not limited to depleted uranium (DU) alloys (18.5 g/cc) and tungsten (W) composites (17.5 g/cc). FIG. 1 is a picture of a typical KE penetrator wherein the sabot has begun to separate.

The performance of DU alloy KE penetrators is believed to be generally superior to comparable density W composite KE penetrators. This is attributed to the DU alloy's susceptibility to adiabatic shear (AS) localization and failure. Under these conditions, the heat generated by the high rate deformation causes thermal softening mechanisms within the penetrator material to compete and eventually overcome the material's work-hardening mechanisms. The plastic deformation can become unstable and the deformation can tend to focus into the plastic localizations known as AS bands. The shear bands provide a mechanism by which the DU penetrator can rapidly discard the deforming material at its head, preventing the build-up of the large "mushroomed" head observed on the W-alloy penetrators. This "self sharpening" behavior allows a DU penetrator to displace a narrower but deeper penetration tunnel, and thus, to burrow through armor protection more efficiently.

FIG. 2 depicts two different penetration mechanisms—FIG. 2A depicts adiabatic shear failure in DU resulting in 'self-sharpening'; and FIG. 2*b* depicts work hardening causing mushrooming in tungsten heavy alloy armor (WHA). As seen in FIG. 2, the penetrator mushrooms within the target, with macroscopic plastic deformation followed by erosion. The initial strain is principally localized within the matrix, which rapidly work hardens to form the mushroom shape. A consequence of the mushrooming due to work hardening is that energy is expended radially to expand the penetration cavity. In DU, unlike in tungsten heavy alloy (WHA), the thermal softening overcomes the increase in flow stress, permitting adiabatic shearing to occur. This results in a 'self-sharpening' of the penetrator, as the mushroom head is continually sheared from the penetrator body, as seen in FIG. 2*a*. The net result is less energy expended in expanding the penetration cavity radially, with a concomitant increase in energy available for axial penetration.

Impacts against hard targets, e.g., rolled homogeneous armor, result in local temperatures as high as 2,500K and pressures at the penetrator/target interface of 5 to 10 GPa. This results in a phase change in uranium from solid to liquid. At these elevated temperatures, the uranium reacts readily with atmospheric oxygen. The oxides formed subsequently condense to solid aerosol particles. Oxidation is the source of the pyrophoric nature of DU impacts and is not present with WHA impacts. This burning effect provides an additional advantage effectiveness of DU penetrators, particularly inside the target. Much work has been conducted in the US on determining the extent to which penetrators are converted to aerosols and on characterizing the aerosol particle size distributions. Against hard targets, it is estimated that 18% of the DU penetrator of 120 mm tank munitions is aerosolized, with virtually all these aerosols (91 to 96%) having sizes <10 um.

Both the DU and WHA penetrators are effective at piercing through the armor; however there are environmental concerns associated with using the DU. This is being addressed by developing W-based composites with ballistic performances equaling or surpassing that of DU. The conventional W composites are produced by liquid-phase sintering elemental powders of tungsten, nickel, iron and/or cobalt to produce a two-phase composite of W particles (typically 30 μm to 50 μm in diameter) embedded in a nickel alloy matrix. The solid state processing technique of ball milling subjects a blend of powders to highly energetic compressive impact forces that produce alloy powders by repeated cold welding and fracturing of the powder particles has shown to give improvements.

The ball milling, which is considered to be a far from equilibrium process (even more so than rapid solidification), yields not only nanograined powder (grain size <100 nm), but also alloys with extended solid solutions. These nanograined powders also may be consolidated at significantly lower temperatures than those used for liquid phase sintered W composites, avoiding the formation of undesirable phases. The high strengths of nanocrystalline metals and alloys, and the saturation or reduction of their work-hardening capacities, can make them prone to shear failure modes, which may mimic the DU rounds.

While new W-composites address the environmental issue, they do not address the issue of poor behind armor damage that is generally associated with KE penetrators. Most KE penetrators do not have any explosives because the high impact pressures and temperatures would cause the explosive to detonate. Additionally, if denotation occurs upon impact, the explosive force would work directly against the penetration force and reduce the amount of penetration. Also, the chemical energy of the explosive would be released in front of the armor and not behind the armor where it can do the most damage. Finally, the addition of conventional explosives which are typically 1-3 gm/cc would substantially lighten the KE penetrator and reduce its penetration effectiveness.

Some of these issues have been addressed by the following methods. One method to improve KE weapons is the PELE ammunition developed in cooperation with GEKE Technologies GmbH from Freiburg, Breisgau. This ammunition does not contain any explosives and is based using a two-component rod consisting of an outer shell and an inner core with different bulk modulus of compressibility and densities. The design works on the simple physical principle: when the penetrator strikes a target, the material in the core is compressed because of its lower density. This compression exerts a pressure on the inside of the shell which forces the warhead apart, producing a large number of fragments which can only move in the direction of firing. Consequently, the effect is limited to a confined and defined area. While this does help improve the behind armor damage, it still only provides kinetic energy and the amount of penetration is reduced.

Another method to enhance KE weapons is provided in U.S. Pat. No. 5,728,968, issued Mar. 17, 1998 to Buzzett, et al. ("the '968 patent"). Such '968 patent invention uses a typical KE round that contains a forward compartment and a rearward compartment separated by a small diameter passageway; all containing a pyrotechnic mixture. The pyrotechnic mixture is a thermite type material containing aluminum, iron oxide, nickel and a fluorocarbon binder. Upon impact the front cavity ignites due to the high temperature and pressure created upon impact. This in turn spontaneously ignites the rest of the pyrotechnic material. The confined space of the rearward compartment creates a high reaction temperature and pressure resulting in molten metal and metal oxide being jetted out the front of the projectile through the small diameter passageway. This chemical energy associated with the jet assists in penetration of the target and creating behind armor damage. In this invention of the '968 patent, the rear cavity and the small diameter bore are required to contain the thermite type material while it is reacting so that the pressure and temperature will build to a condition that material is propelled out the small diameter bore. This requires extensive machining and limits the amount of energetic material that can be carried to the target.

Hence there still exists a need to more efficiently couple a kinetic energy projectile to a target, produce more behind armor damage and be able to provide more chemical energy to assist in the behind armor damage.

BRIEF DESCRIPTION OF THE INVENTION

In an embodiment of the current invention, a new composition containing powdered metal and a metal oxide thermite pair is used inside a kinetic energy penetrator. The powders are generally in the micron range (typically having an average particulate size of at most about 5 microns and, more typically, at most about 2 microns) and more optimally in the nano-scale range (In the current invention, nano refers to a material having dimensions less than about 1 micron. Generally, the dimensions are less than about 500 nm, and even more so less than about 100 nm). The new compositions react much quicker than the conventional thermite compositions and do not require a forward and aft compartment. Hence, the penetrator is less expensive to manufacture. Additionally, the compositions can be tailored to react over a wide range of rates from 1-1000's of feet per second. The compositions can also be designed in a wide range of densities much heavier and contains higher energy densities than conventional explosives. Lastly, the new material does not require the high impact velocities to ignite or detonate, hence, it can be used over a broader velocity range.

In another embodiment, a material referred to as binary MIC is used inside the penetrator. In this invention, the two or more components of the thermite pair are layered or physically separated within the penetrator. Upon impact, the difference in densities of the two components causes the particles to intimately mix and react. Hence, a very insensitive munition is created in which the components will not react during shipping and handling operations. Lastly, the densities of the formulations can be very heavy such that the ballistic coefficient is not reduced.

In another embodiment, the penetrator is also filled with the metal oxide, optimally also nano-scale, and the target is used as the fuel source. When a KE penetrator impacts a target, some of the target is vaporized due to the impact temperatures. This material provides the metal component of the reaction while the metal oxide inside the penetrator provides the second component of the reaction. The result is a truly insensitive munition that has both kinetic and chemical energy and retains a high ballistic coefficient.

In another embodiment, the penetrator housing provides one component and the second component is contained within the housing, optimally also as a nano-scale component. Upon impact, the penetrator vaporizes and reacts with the material inside the penetrator releasing the chemical energy. Again, a truly insensitive munition is created.

In yet another embodiment, nano-scale material is used inside the penetrator and better coupling to the target is accomplished due to vaporization of the nano-scale material. Nano-scale materials have a reduced enthalpy of vaporization, hence the material will vaporize more readily and quicker than conventional powders. This results in more gas generation and consequently more damage to the target while still being able to maintain a high mass density. It also creates an insensitive munition.

In another embodiment, the new composition, either the thermite pair or inert material, is used in a conventional ballistic round such as a bullet. In this embodiment, the higher sensitivity of the material relative to conventional thermite formulations allows the material to react upon impact without the need for a primary explosive.

SUMMARY OF THE INVENTION

The current invention relates to the fields of ballistic and kinetic energy (KE) weapons. Specifically a novel apparatus and use of nanomaterials has been developed to make significant improvements over existing weapons. By incorporating nano-scale particles as a filler material for kinetic energy weapons several advancements are realized.

DETAILED DESCRIPTION OF PREFERRED EMBODIMENTS

The current invention incorporates powder into a ballistic and kinetic weapon projectiles to produce unexpected results when it contacts the target and appears to provide more efficient transfer of the kinetic energy to the target. The invention takes advantage of several mechanical and thermodynamic properties that occur with the powders (typically having at least about 10% porosity, and, more typically, at least about 20% porosity), upon impact such as pore collapse, compression heating of the pore gases, frictional heating at the particle boundaries and explosive vaporization due to shock loading. Additionally nanopowders have unique properties such as: (a) decreased thermodynamic phase change temperatures; (b) decreased enthalpies associated with the phase change; (c) high energy, metastable crystalline phases and their associated high internal stress states; (d) large thermal contact resistance at the nanoparticle interface; (e) high deformation energies due to the monocrystalline nature of nanoparticles; (f) high pore volume (entrapped gas); and (g) higher grain boundary (surface) area to volume ratio. These unique nano-scale properties enhance the effects that occur with the powders and provide even more performance. By taking advantage of these types of properties, the new projectiles are able to produces larger penetration holes and produce more behind armor damage than a convention solid projectile.

Figure 1:
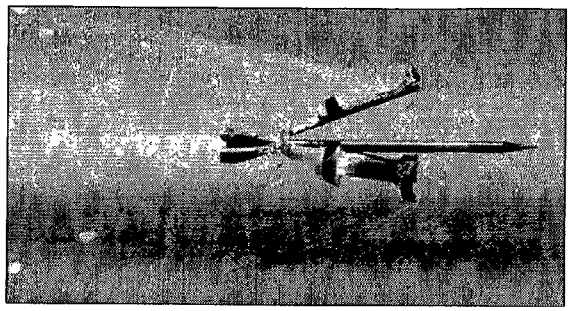
Figure 1 PRIOR ART
FIG. 1 shows an example of hypervelocity kinetic weapon.
Figure 2:
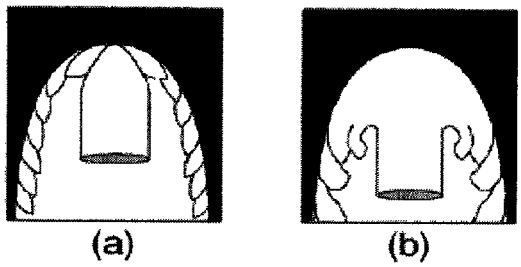
FIG. 2 is are diagrams (2A and 2B) depicting two different penetration mechanisms.
Figure 3:
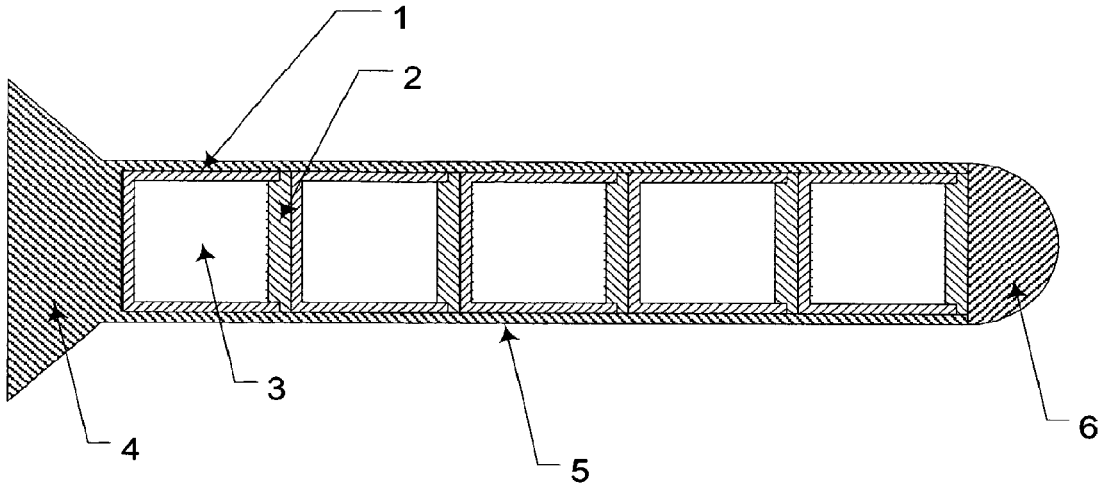
FIG. 3 illustrates an embodiment of the present invention with multiple nanomaterial capsules.

FIG. 3 illustrates an embodiment of a projectile that was designed and tested. This embodiment consisted of an outer body 5 made of a high strength material, such as steel, that was approximately 2.5 cm in diameter. The overall length of this projectile was 12 cm and contained an aerodynamic nose 6 and a stabilization flair 4, also made of high strength materials. Contained within the interior of the body 5 were five aluminum cups 1 with lids 2. The composition of the cups is not critical and other materials, such as but not limited to, metals, plastics, polymers and ceramics can be utilized. In this embodiment, the cups 1 were approximately 1.25 cm OD by 1.1 cm ID by 1.2 cm long. Each cup 1 was pressed with material 3 and then the lid was epoxied to the cup 1. The OD of the cups 1 were slightly less than the ID of the bore body 5, such that the cups 1 could be slid into the bore of the body 5. The cups 1 contacted one another and any excess axial play was removed. This provided a small shell that allowed easy compaction of the powder to the desired density. In this embodiment, multiple shells were used mainly because these cups 1 were readily available. The design allowed the amount of cups 1 and consequently powder to be readily changed and re-configured. For example, each cup 1 could contain a different material or be pressed to a different percent of theoretical maximum density.

One feature of the embodiment is the material 3. The material 3 may be energetic, reactive with the target or atmosphere, inert, or a combination of two or all three. The material 3 is comprised a component of a thermite pair such that the target and or the projectile body supplies the fuel or oxidizer while the powder supplies the second component of the thermite pair. Some examples of other thermite reactions are given in the following table as presented in the publication "Theoretical Energy Release of Thermites, Intermetallics, and Combustible Metals," S. H. Fischer and M. C Grubelich, 24$^{th}$ *International Pyrotechnics Seminar,* July 1998.

TABLE 1

Thermite Reactions (in Alphabetical Order)

| reactants | | adiabatic reaction temperature (K) | | state of products | | gas production | | heat of reaction | |
|---|---|---|---|---|---|---|---|---|---|
| constituents | ρTMD, g/cm$^3$ | w/o phase changes | w/phase changes | state of oxide | state of metal | moles gas per 100 g | g of gas per g | −Q, cal/g | −Q, cal/cm$^3$ |
| 2Al + 3AgO | 6.085 | 7503 | 3253 | l-g | gas | 0.7519 | 0.8083 | 896.7 | 5457 |
| 2Al + 3Ag$_2$O | 6.386 | 4941 | 2436 | liquid | l-g | 0.4298 | 0.4636 | 504.8 | 3224 |
| 2Al + B$_2$O$_3$ | 2.524 | 2621 | 2327 | s-l | solid | 0.0000 | 0.0000 | 780.7 | 1971 |
| 2Al + Bi$_2$O$_3$ | 7.188 | 3995 | 3253 | l-g | gas | 0.4731 | 0.8941 | 506.1 | 3638 |
| 2Al + 3CoO | 5.077 | 3392 | 3201 | liquid | l-g | 0.0430 | 0.0254 | 824.7 | 4187 |
| 8Al + 3Co$_3$O$_4$ | 4.716 | 3938 | 3201 | liquid | l-g | 0.2196 | 0.1294 | 1012 | 4772 |
| 2Al + Cr$_2$O$_3$ | 4.190 | 2789 | 2327 | s-l | liquid | 0.0000 | 0.0000 | 622.0 | 2606 |
| 2Al + 3CuO | 5.109 | 5718 | 2843 | liquid | l-g | 0.5400 | 0.3431 | 974.1 | 4976 |
| 2Al + 3Cu$_2$O | 5.280 | 4132 | 2843 | liquid | l-g | 0.1221 | 0.0776 | 575.5 | 3039 |
| 2Al + Fe$_2$O$_3$ | 4.175 | 4382 | 3135 | liquid | l-g | 0.1404 | 0.0784 | 945.4 | 3947 |
| 8Al + 3Fe$_3$O$_4$ | 4.264 | 4057 | 3135 | liquid | l-g | 0.0549 | 0.0307 | 878.8 | 3747 |
| 2Al + 3HgO | 8.986 | 7169 | 3253 | l-g | gas | 0.5598 | 0.9913 | 476.6 | 4282 |
| 10Al + 3I$_2$O$_5$ | 4.119 | 8680 | >3253 | gas | gas | 0.6293 | 1.0000 | 1486 | 6122 |
| 4Al + 3MnO$_2$ | 4.014 | 4829 | 2918 | liquid | gas | 0.8136 | 0.4470 | 1159 | 4651 |

TABLE 1-continued

Thermite Reactions (in Alphabetical Order)

| reactants | | adiabatic reaction temperature (K) | | state of products | | gas production | | heat of reaction | |
|---|---|---|---|---|---|---|---|---|---|
| constituents | ρTMD, g/cm³ | w/o phase changes | w/phase changes | state of oxide | state of metal | moles gas per 100 g | g of gas per g | −Q, cal/g | −Q, cal/cm³ |
| $2Al + MoO_3$ | 3.808 | 5574 | 3253 | l-g | liquid | 0.2425 | 0.2473 | 1124 | 4279 |
| $10Al + 3Nb_2O_5$ | 4.089 | 3240 | 2705 | liquid | solid | 0.0000 | 0.0000 | 600.2 | 2454 |
| $2Al + 3NiO$ | 5.214 | 3968 | 3187 | liquid | l-g | 0.0108 | 0.0063 | 822.3 | 4288 |
| $2Al + Ni_2O_3$ | 4.045 | 5031 | 3187 | liquid | l-g | 0.4650 | 0.2729 | 1292 | 5229 |
| $2Al + 3PbO$ | 8.018 | 3968 | 2327 | s-l | gas | 0.4146 | 0.8591 | 337.4 | 2705 |
| $4Al + 3PbO_2$ | 7.085 | 6937 | 3253 | l-g | gas | 0.5366 | 0.9296 | 731.9 | 5185 |
| $8Al + 3Pb_3O_4$ | 7.428 | 5427 | 3253 | l-g | gas | 0.4215 | 0.8466 | 478.1 | 3551 |
| $2Al + 3PdO$ | 7.281 | 5022 | 3237 | liquid | l-g | 0.6577 | 0.6998 | 754.3 | 5493 |
| $4Al + 3SiO_2$ | 2.668 | 2010 | 1889 | solid | liquid | 0.0000 | 0.0000 | 513.3 | 1370 |
| $2Al + 3SnO$ | 5.540 | 3558 | 2876 | liquid | l-g | 0.1070 | 0.1270 | 427.0 | 2366 |
| $4Al + 3SnO_2$ | 5.356 | 5019 | 2876 | liquid | l-g | 0.2928 | 0.3476 | 686.8 | 3678 |
| $10Al + 3Ta_2O_5$ | 6.339 | 3055 | 2452 | liquid | solid | 0.0000 | 0.0000 | 335.6 | 2128 |
| $4Al + 3TiO_2$ | 3.590 | 1955 | 1752 | solid | liquid | 0.0000 | 0.0000 | 365.1 | 1311 |
| $16Al + 3U_3O_5$ | 4.957 | 1406 | 1406 | solid | solid | 0.0000 | 0.0000 | 487.6 | 2417 |
| $10Al + 3V_2O_5$ | 3.107 | 3953 | 3273 | l-g | liquid | 0.0699 | 0.0356 | 1092 | 3394 |
| $4Al + 3WO_2$ | 8.085 | 4176 | 3253 | l-g | solid | 0.0662 | 0.0675 | 500.6 | 4047 |
| $2Al + WO_3$ | 5.458 | 5544 | 3253 | l-g | liquid | 0.1434 | 0.1463 | 696.4 | 3801 |
| $2B + Cr_2O_3$ | 4.590 | 977 | 917 | liquid | solid | 0.0000 | 0.0000 | 182.0 | 835.3 |
| $2B + 3CuO$ | 5.665 | 4748 | 2843 | gas | l-g | 0.4463 | 0.2430 | 738.1 | 4182 |
| $2B + Fe_2O_3$ | 4.661 | 2646 | 2065 | liquid | liquid | 0.0000 | 0.0000 | 590.1 | 2751 |
| $8B + Fe_3O_4$ | 4.644 | 2338 | 1903 | liquid | liquid | 0.0000 | 0.0000 | 530.1 | 2462 |
| $4B + 3MnO_2$ | 4.394 | 3000 | 2133 | l-g | liquid | 0.3198 | 0.1715 | 773.1 | 3397 |
| $8B+ 3Pb_3O_4$ | 8.223 | 4217 | 2019 | liquid | l-g | 0.4126 | 0.8550 | 326.9 | 2688 |
| $3Be + B_2O_3$ | 1.850 | 3278 | 2573 | liquid | s-l | 0.0000 | 0.0000 | 1639 | 3033 |
| $3Be + Cr_2O_3$ | 4.089 | 3107 | 2820 | s-l | liquid | 0.0000 | 0.0000 | 915.0 | 3741 |
| $Be + CuO$ | 5.119 | 3761 | 2820 | s-l | liquid | 0.0000 | 0.0000 | 1221 | 6249 |
| $3Be + Fe_2O_3$ | 4.163 | 4244 | 3135 | liquid | l-g | 0.1029 | 0.0568 | 1281 | 5332 |
| $Be + Fe_3O_4$ | 4.180 | 4482 | 3135 | liquid | l-g | 0.0336 | 0.0188 | 1175 | 4910 |
| $2Be + MnO_2$ | 3.882 | 6078 | 2969 | liquid | gas | 0.9527 | 0.5234 | 1586 | 6158 |
| $2Be + PbO_2$ | 7.296 | 8622 | 4123 | l-g | gas | 0.4665 | 0.8250 | 875.5 | 6387 |
| $4Be + Pb_3O_4$ | 7.610 | 5673 | 3559 | liquid | gas | 0.4157 | 0.8614 | 567.8 | 4322 |
| $2Be + SiO_2$ | 2.410 | 2580 | 2482 | solid | liquid | 0.0000 | 0.0000 | 936.0 | 2256 |
| $3Hf + 2B_2O_3$ | 6.125 | 2656 | 2575 | solid | liquid | 0.0000 | 0.0000 | 296.5 | 1816 |
| $3Hf + 2Cr_2O_3$ | 7.971 | 2721 | 2572 | solid | liquid | 0.0000 | 0.0000 | 302.3 | 2410 |
| $Hf + 2CuO$ | 8.332 | 5974 | 2843 | solid | l-g | 0.3881 | 0.2466 | 567.6 | 4730 |
| $3Hf + 2Fe_2O_3$ | 7.955 | 5031 | 2843 | solid | l-g | 0.2117 | 0.1183 | 473.3 | 3765 |
| $2Hf + Fe_3O_4$ | 7.760 | 4802 | 2843 | solid | l-g | 0.1835 | 0.1025 | 450.4 | 3496 |
| $Hf + MnO_2$ | 8.054 | 5644 | 3083 | s-l | gas | 0.3263 | 0.3131 | 534.6 | 4305 |
| $2Hf + Pb_3O_4$ | 9.775 | 9382 | 4410 | liquid | gas | 0.2877 | 0.5962 | 345.9 | 3381 |
| $Hf + SiO_2$ | 6.224 | 2117 | 1828 | solid | liquid | 0.0000 | 0.0000 | 203.3 | 1265 |
| $2La + 3AgO$ | 6.827 | 8177 | 4173 | liquid | gas | 0.4619 | 0.4983 | 646.7 | 4416 |
| $2La + 3CuO$ | 6.263 | 6007 | 2843 | liquid | l-g | 0.3737 | 0.2374 | 606.4 | 3798 |
| $2La + Fe_2O_3$ | 5.729 | 4590 | 3135 | liquid | l-g | 0.1234 | 0.0689 | 529.6 | 3034 |
| $2La + 3HgO$ | 8.962 | 7140 | >4472 | l-g | gas | .32-.43 | 0.65-1 | 392.0 | 3513 |
| $10La + 3I_2O_5$ | 5.501 | 9107 | >4472 | gas | gas | 0.3347 | 1.0000 | 849.2 | 4672 |
| $4La + 3MnO_2$ | 5.740 | 5270 | 3120 | liquid | gas | 0.3674 | 0.2019 | 593.4 | 3406 |
| $2La + 3PbO$ | 8.207 | 4598 | 2609 | liquid | gas | 0.3166 | 0.6561 | 287.4 | 2359 |
| $4La + 3PbO_2$ | 7.629 | 7065 | >4472 | gas | gas | 0.3927 | 1.0000 | 518.8 | 3958 |
| $8La + 3Pb_3O_4$ | 7.789 | 5628 | 4049 | liquid | gas | 0.2841 | 0.5886 | 378.6 | 2949 |
| $2La + 3PdO$ | 7.769 | 5635 | 3237 | liquid | l-g | 0.2450 | 0.2606 | 536.2 | 4166 |
| $4La + 3WO_2$ | 8.366 | 3826 | 3218 | liquid | solid | 0.0000 | 0.0000 | 361.2 | 3022 |
| $2La + WO_3$ | 6.572 | 5808 | 4367 | liquid | liquid | 0.0000 | 0.0000 | 445.8 | 2930 |
| $6Li + B_2O_3$ | 0.891 | 2254 | 1843 | s-l | solid | 0.0000 | 0.0000 | 1293 | 1152 |
| $6Li + Cr_2O_3$ | 1.807 | 2151 | 1843 | s-l | solid | 0.0000 | 0.0000 | 799.5 | 1445 |
| $2Li + CuO$ | 2.432 | 4152 | 2843 | liquid | l-g | 0.2248 | 0.1428 | 1125 | 2736 |
| $6Li + Fe_2O_3$ | 1.863 | 3193 | 2510 | liquid | liquid | 0.0000 | 0.0000 | 1143 | 2130 |
| $8Li + Fe_3O_4$ | 0.517 | 3076 | 2412 | liquid | liquid | 0.0000 | 0.0000 | 1053 | 2036 |
| $4Li + MnO_2$ | 1.656 | 3336 | 2334 | liquid | l-g | 0.4098 | 0.2251 | 1399 | 2317 |
| $6Li + MoO_3$ | 1.688 | 4035 | 2873 | l-g | solid | 0.2155 | 0.0644 | 1342 | 2265 |
| $8Li + Pb_3O_4$ | 4.133 | 4186 | 2873 | l-g | liquid | 0.1655 | 0.0496 | 536.7 | 2218 |
| $4Li + SiO_2$ | 1.177 | 1712 | 1687 | solid | s-l | 0.0000 | 0.0000 | 763.9 | 898.7 |
| $6Li + WO_3$ | 2.478 | 3700 | 2873 | l-g | solid | 0.0113 | 0.0034 | 825.4 | 2046 |
| $3Mg + B_2O_3$ | 1.785 | 6389 | 3873 | l-g | liquid | 0.4981 | 0.2007 | 2134 | 1195 |
| $3Mg + Cr_2O_3$ | 3.164 | 3788 | 2945 | solid | l-g | 0.1023 | 0.0532 | 813.1 | 2573 |
| $Mg + CuO$ | 3.934 | 6502 | 2843 | solid | l-g | 0.8186 | 0.5201 | 1102 | 4336 |
| $3Mg + Fe_2O_3$ | 3.224 | 4703 | 3135 | liquid | l-g | 0.2021 | 0.1129 | 1110 | 3579 |
| $4Mg + Fe_3O_4$ | 3.274 | 4446 | 3135 | liquid | l-g | 0.1369 | 0.0764 | 1033 | 3383 |
| $2Mg + MnO_2$ | 2.996 | 5209 | 3271 | liquid | gas | 0.7378 | 0.4053 | 1322 | 3961 |
| $4Mg + Pb_3O_4$ | 5.965 | 5883 | 3873 | l-g | gas | 0.4216 | 0.8095 | 556.0 | 3316 |
| $2Mg + SiO_2$ | 2.148 | 3401 | 2628 | solid | l-g | 0.9200 | 0-.26 | 789.6 | 1695 |
| $2Nd + 3AgO$ | 7.244 | 7628 | 3602 | liquid | gas | 0.4544 | 0.4902 | 625.9 | 4534 |
| $2Nd + 3CuO$ | 6.719 | 5921 | 2843 | liquid | l-g | 0.3699 | 0.2350 | 603.4 | 4054 |

TABLE 1-continued

| Thermite Reactions (in Alphabetical Order) | | | | | | | | | |
|---|---|---|---|---|---|---|---|---|---|
| reactants | | adiabatic reaction temperature (K) | | state of products | | gas production | | heat of reaction | |
| constituents | ρTMD, g/cm$^3$ | w/o phase changes | w/phase changes | state of oxide | state of metal | moles gas per 100 g | g of gas per g | −Q, cal/g | −Q, cal/cm$^3$ |
| 2Nd + 3HgO | 9.430 | 7020 | <5374 | gas | gas | 0.4263 | 1.0000 | 392.7 | 3703 |
| 10Nd + 3$I_2O_5$ | 5.896 | 10067 | <7580 | gas | gas | 0.3273 | 1.0000 | 840.6 | 4956 |
| 4Nd + 3$MnO_2$ | 6.241 | 5194 | 3287 | liquid | gas | 0.3580 | 0.1967 | 589.9 | 3682 |
| 4Nd + 3$PbO_2$ | 8.148 | 6938 | <5284 | gas | gas | 0.3862 | 1.0000 | 517.8 | 4219 |
| 8Nd + 3$Pb_3O_4$ | 8.218 | 5553 | 3958 | liquid | gas | 0.2803 | 0.5808 | 379.6 | 3120 |
| 2Nd + 3PdO | 8.297 | 6197 | 3237 | liquid | l-g | 0.2394 | 0.2547 | 532.7 | 4420 |
| 4Nd + 3$WO_2$ | 9.016 | 4792 | 3778 | liquid | liquid | 0.0000 | 0.0000 | 362.9 | 3272 |
| 2Nd + $WO_1$ | 7.074 | 5438 | 4245 | liquid | liquid | 0.0000 | 0.0000 | 446.1 | 3156 |
| 2Ta + 5AgO | 9.341 | 6110 | 2436 | liquid | l-g | 0.4229 | 0.4562 | 466.2 | 4355 |
| 2Ta + 5CuO | 9.049 | 4044 | 2843 | liquid | l-g | 0.0776 | 0.0493 | 390.3 | 3532 |
| 6Ta + 5$Fe_2O_3$ | 9.185 | 2383 | 2138 | solid | liquid | 0.0000 | 0.0000 | 235.0 | 2558 |
| 2Ta + 5HgO | 12.140 | 5285 | <4200 | liquid | gas | 0.3460 | 0.6942 | 263.3 | 3120 |
| 2Ta + $I_2O_5$ | 7.615 | 8462 | 7240 | gas | gas | 0.2875 | 1.0000 | 648.6 | 4939 |
| 2Ta + 5PbO | 10.640 | 2752 | 2019 | solid | l-g | 0.1475 | 0.3056 | 154.5 | 1644 |
| 4Ta + 5$PbO_2$ | 11.215 | 4935 | 3472 | liquid | gas | 0.2604 | 0.5397 | 338.6 | 3797 |
| 8Ta + 5$Pb_3O_4$ | 10.510 | 3601 | 2019 | solid | l-g | 0.2990 | 0.6196 | 225.0 | 2365 |
| 2Ta + 5PdO | 11.472 | 4344 | 3237 | liquid | l-g | 0.0575 | 0.0612 | 360.4 | 4135 |
| 4Ta + 5$WO_2$ | 13.515 | 2556 | 2196 | liquid | solid | 0.0000 | 0.0000 | 145.1 | 1962 |
| 6Ta + 5$WO_3$ | 9.876 | 2883 | 2633 | liquid | solid | 0.0000 | 0.0000 | 206.2 | 2036 |
| 3Th + 2$B_2O_3$ | 6.688 | 3959 | 3135 | solid | liquid | 0.0000 | 0.0000 | 337.8 | 2259 |
| 3Th + 2$Cr_2O_3$ | 8.300 | 4051 | 2945 | solid | l-g | 0.0590 | 0.0307 | 334.5 | 2776 |
| Th + 2CuO | 8.582 | 7743 | 2843 | solid | l-g | 0.4301 | 0.3421 | 558.7 | 4795 |
| 3Th + 2$Fe_2O_3$ | 8.280 | 6287 | 3135 | solid | l-g | 0.2619 | 0.1463 | 477.9 | 3957 |
| 2Th + $Fe_3O_4$ | 8.092 | 5912 | 3135 | solid | l-g | 0.2257 | 0.1261 | 458.5 | 3710 |
| Th + $MnO_2$ | 8.391 | 7151 | 3910 | liquid | gas | 0.3135 | 0.1722 | 529.2 | 4440 |
| Th + $PbO_2$ | 10.19 | 10612 | 4673 | l-g | gas | 0.2817 | 0.6231 | 482.8 | 4922 |
| 2Th + $Pb_3O_4$ | 9.845 | 8532 | 4673 | l-g | gas | 0.2695 | 0.5633 | 360.5 | 3549 |
| Th + $SiO_2$ | 6.732 | 3813 | 2628 | solid | l-g | 0-.34 | 0-.10 | 258.2 | 1738 |
| 3Ti + 2$B_2O_3$ | 2.791 | 1498 | 1498 | solid | solid | 0.0000 | 0.0000 | 276.6 | 772.0 |
| 3Ti + 2$Cr_2O_3$ | 4.959 | 1814 | 1814 | solid | solid | 0.0000 | 0.0000 | 296.2 | 1469 |
| Ti + 2CuO | 5.830 | 5569 | 2843 | liquid | l-g | 0.3242 | 0.2060 | 730.5 | 4259 |
| 3Ti + 2$Fe_2O_3$ | 5.010 | 3358 | 2614 | liquid | liquid | 0.0000 | 0.0000 | 612.0 | 3066 |
| Ti + $Fe_3O_4$ | 4.974 | 3113 | 2334 | liquid | liquid | 0.0000 | 0.0000 | 563.0 | 2800 |
| Ti + $MnO_2$ | 4.826 | 3993 | 2334 | liquid | l-g | 0.3783 | 0.2078 | 752.7 | 3633 |
| 2Ti + $Pb_3O_4$ | 8.087 | 5508 | 2498 | liquid | gas | 0.3839 | 0.7955 | 358.1 | 2896 |
| Ti + $SiO_2$ | 3.241 | 715 | 715 | solid | solid | 0.0000 | 0.0000 | 75.0 | 243.1 |
| 2Y + 3CuO | 5.404 | 7668 | 3124 | liquid | l-g | 0.7204 | 0.4577 | 926.7 | 5008 |
| 8Y + 3$Fe_3O_4$ | 4.803 | 5791 | 3135 | liquid | l-g | 0.3812 | 0.2129 | 856.3 | 4113 |
| 10Y + 3$I_2O_5$ | 4.638 | 12416 | >4573 | gas | gas | 0.4231 | 1.0000 | 1144 | 5308 |
| 4Y + 3$MnO_2$ | 4.690 | 7405 | <5731 | gas | gas | 0.8110 | 1.0000 | 1022 | 4792 |
| 2Y + $MoO_3$ | 4.567 | 8778 | >4572 | gas | liquid | 0.6215 | 1.0000 | 1005 | 4589 |
| 2Y + $Ni_2O_3$ | 4.636 | 7614 | 3955 | liquid | gas | 0.5827 | 0.3420 | 1120 | 5194 |
| 4Y + 3$PbO_2$ | 6.875 | 9166 | >4572 | gas | gas | 0.4659 | 1.0000 | 751.0 | 5163 |
| 2Y + 3PdO | 7.020 | 8097 | 3237 | liquid | l-g | 0.4183 | 0.4451 | 768.1 | 5371 |
| 4Y + 3$SnO_2$ | 5.604 | 7022 | 4573 | l-g | gas | .37-.62 | 0.44-1 | 726.1 | 4068 |
| 10Y + 3$Ta_2O_5$ | 6.316 | 5564 | >4572 | l-g | liquid | 0-0.23 | 0-0.51 | 469.7 | 2966 |
| 10Y + 3$V_2O_4$ | 3.970 | 7243 | >3652 | l-g | gas | 0.2130 | 0.4181 | 972.5 | 3861 |
| 2Y + $WO_3$ | 5.677 | 8296 | >4572 | gas | liquid | 0.2441 | 0.5512 | 732.2 | 4157 |
| 3Zr + 2$B_2O_3$ | 3.782 | 2730 | 2573 | solid | s-l | 0.2930 | 0.0317 | 437.4 | 1654 |
| 3Zr + 2$Cr_2O_3$ | 5.713 | 2915 | 2650 | solid | liquid | 0.0000 | 0.0000 | 423.0 | 2417 |
| Zr + 2CuO | 6.400 | 6103 | 2843 | solid | l-g | 0.5553 | 0.3529 | 752.9 | 4818 |
| 3Zr + 2$Fe_2O_3$ | 5.744 | 4626 | 3135 | liquid | l-g | 0.0820 | 0.0458 | 666.2 | 3827 |
| 2Zr + $Fe_3O_4$ | 5.668 | 4103 | 3135 | liquid | l-g | 0.0277 | 0.0155 | 625.1 | 3543 |
| Zr + $MnO_2$ | 5.647 | 5385 | 2983 | s-l | gas | 0.5613 | 0.3084 | 778.7 | 4398 |
| 2Zr + $Pb_3O_4$ | 8.359 | 6595 | 3300 | l-g | gas | 0.3683 | 0.7440 | 408.1 | 3412 |
| Zr + $SiO_2$ | 4.098 | 2233 | 1687 | solid | s-l | 0.0000 | 0.0000 | 299.7 | 1228 |

It is understood that highly reactive metals, such as aluminum particles, produced with micron to sub micron particle sizes can contribute to increased performance in several energetic applications such as explosives, propellants and pyrotechnic devices. Compared to conventional metals of large micron size or above, nanosized aluminum particles exhibit much faster energy release and more complete combustion. Wilson, D. E., and Kim, K., "A Simplified Model for the Combustion of Al/$MoO_3$ Nanocomposite Thermites," AIAA Paper 2003-4536, 2003, showed that the relevant thermochemistry effects of loose aluminum powder scale as the square of the particle diameter. Aluminum powder is popular reducing agent in super-thermite reactions, since its oxide form ($Al_2O_3$) has very high heat of formation ($-\Delta H_f$=1675.7 kJ/mol). When nanoaluminum is mixed with a metal oxidizer, a very reactive super-thermite formulation ("MIC") is formed. The reaction is even faster when a nano-scale metal oxidizer is used. This reaction can be characterized by a rapid, highly exothermic reaction with high-energy release given by: $Al+MoO_3 \rightarrow Al_2O_3+Mo+\Delta E$ MJ/kg. The reaction enthalpy of a stoichiometric mixture is comparable to conventional high explosives such as TNT or HMX. While the Al and $MoO_3$ are used in the present invention by example, other thermite reactions, when produced at the nano-scale, exhibit similar phenomena.

An interest in MIC lies in its ability to release energy in a controllable fashion, coupled with its high energy density and variable mass density. It has become one of the most (if not the most) studied subset of nanoenergetics, primarily because of its unusual and interesting characteristics, some of which are:

Super high-temperatures~7000K

Higher energy density than organic explosives~2×

Variable mass density~3 to 12 g/cc.

Tunable energy release rate~4 orders of magnitude

By-products are benign~"green" applications

These properties make nanoenergetic materials a suitable candidate for material 3.

Alternatively, materials and more preferably nanomaterials such as ceramics and metal oxides, nitrides, and fluorides that are relatively inert can be used as the material 3. These include, but are not limited to, zirconia, alumina, niobia, titania, iron oxide, molytrioxide, nickel oxide, silver oxide, tantalum oxide, tungsten oxide, hafnium oxide, ceria, magnesium oxide, copper oxide, bismuth oxide, tin oxide, chromium oxide, tantalum oxide, lead oxide, boron oxide, silica, and uranium oxide.

Also alternatively, metals and more preferably nanometals such as but not limited to iron, aluminum, tungsten, hafnium, tantalum, chromium, tin, bismuth, lead, copper and their alloys, can be used.

Generally with ballistic weapons, high mass density materials are desired to provide more mass for a given volume. Combinations of different materials can also be used to obtain the desired densities. For some embodiments of the present invention, dry nanopowders were used where in other embodiments micron powders were used. Other nanostructured materials such as foams, aerogels, fibers, tubes and filaments may be used.

In the case were a thermite material is used, the powder can be a mixture of two or more components. Additionally, the powder may be pressed to form layers of the two or more materials. This would mitigate the reactive nature of the material during normal handling operation; however, during impact the density differences between the two materials will cause them to intimately mix and react. Hence, a highly reactive material can be made that is insensitive due to the segregating of the materials. A third material could also be used in the layering to isolate the powder constituents to make it even less reactive during normal operations. Another method would be to use layered particles where each particle contains the constituents.

Two nanomaterials 3 were used in the current embodiment, MIC and zirconia compacted loose powders. Unless indicated otherwise, the nanomaterials are commercially available materials manufactured by Nanotechnologies, Inc., Austin Tex. The MIC consisted of 80 nm aluminum (approximately 84% active aluminum content) and micron platelets (10s of nanometers thick) of molytrioxide at the following percentages 45 and 55, respectively. Each cup contained approximately 2.0 g of MIC powder pressed to 50% of theoretical maximum density. The zirconia used was 30 nm loose powder pressed to 40% theoretical maximum density and contained a total of approximately 2.0 g of nanomaterial. Another zirconia purchased from Sigma-Aldrich, Inc., St. Louis, Ky. and described as Zirconium (IV) oxide, powder, <5 micron, 99% was also tested. Independent BET measurements of the material indicated that the Sigma-Aldrich material was approximately 220 nm in size. TEM images suggest that these Sigma-Aldrich particles were approximately 200-500 nm and were somewhat agglomerated. For the current invention, the particle size may be in the range of several nanometers to many microns. This loose zirconia powder from Sigma-Aldrich was pressed to 40% theoretical maximum density and contained a total of approximately 2.5 g of material. In all of these cases the cups containing the nanomaterial had significant porosity, thus even under consolidation they behave as individual nanoparticles insofar as their properties are concerned. The total weight of the nano-enhanced projectiles was approximately 145 g.

Figure 4:
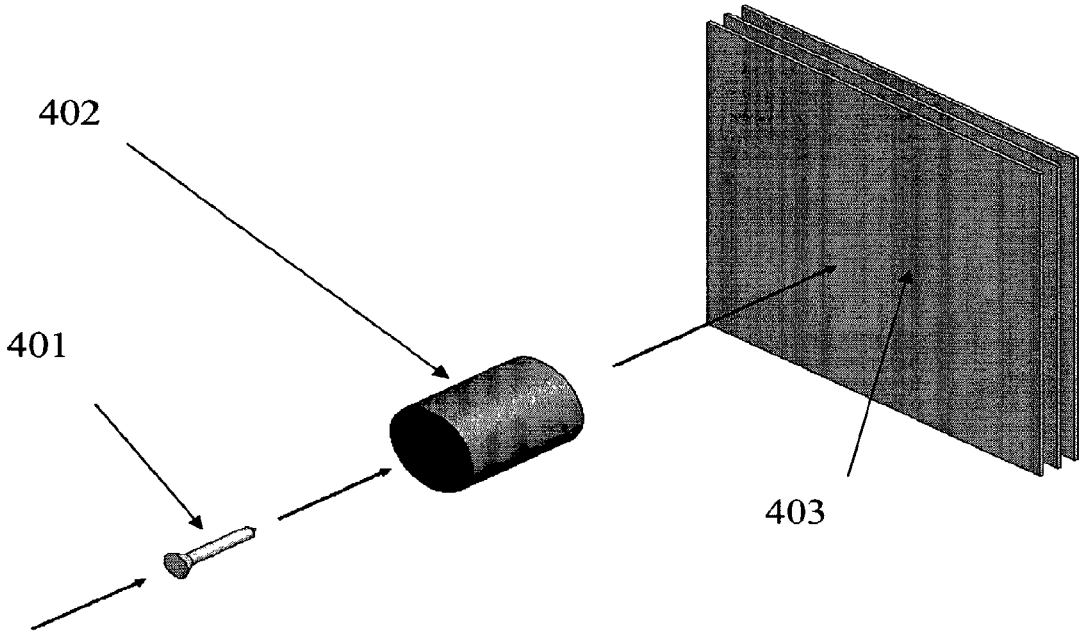
FIG. 4 depicts a schematic of a test performed with an embodiment of the current invention.

FIG. 4 depicts a sketch of the test set-up. Each projectile 401 was fired at approximately 2 km/s using a light gas gun [not shown] into simulated armor 402 (a 6-in diameter aluminum target 7-in long). A three-piece plastic sabot (not shown) was used to center the projectile and assist in the launch of the projectile. Four ½-in steel witness plates 403 were positioned approximately 2 feet behind the aluminum target to measure the amount of damage that resulted behind the armor blast.

Figure 5:
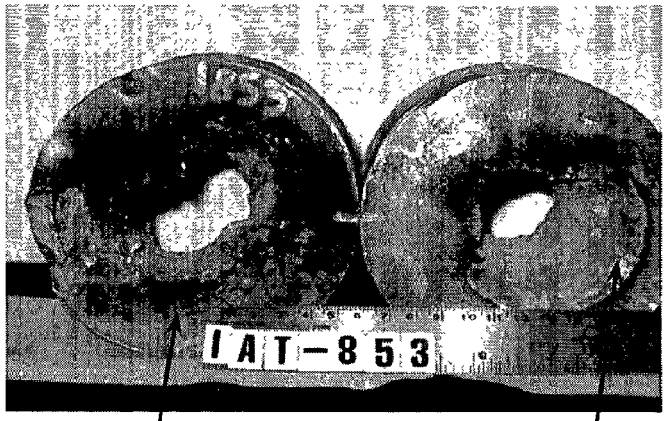
FIG. 5 is a set of photographs (5A and 5B) of a target from a test using nano-enhanced projectiles of the current invention.
Figure 5:
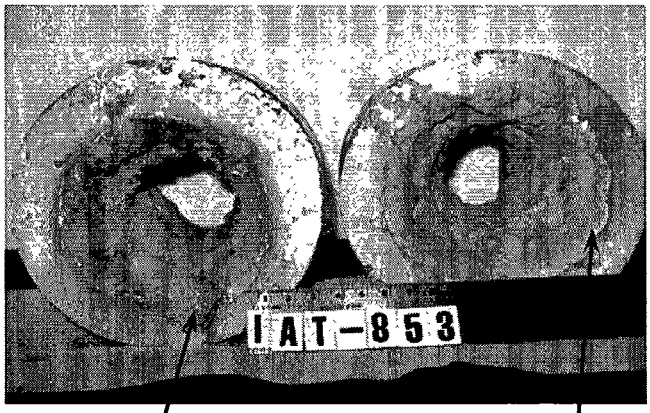

FIG. 5 are a set of photographs (5A and 5B) showing targets penetrated by nano-enhanced projectiles of the present invention. FIG. 5A is the front view of two targets 501 and 502 and FIG. 5B is the rear view of the same two targets 501 and 502. In both of FIGS. 5A and 5B, the target 501 is the result of a testing using an embodiment projectile with MIC and target 502 is the result of testing using an embodiment with an inert zirconia (ZrO2). Numerical simulations of a similar weight and shaped projectile predicted that it would not penetrate through the target. Nonetheless, as shown in FIG. 5, the targets 501 and 502 clearly show that the projectile penetrated through the targets. A comparison of the two targets 501 and 502 shown in FIG. 5 reveals there was a significant increase in diameter through target 501 (i.e., the target resulting for the projectile using MIC) and that this target 501 had a hole that was more jagged than target 502 (thus showing the explosive type effects resulting from the use of MIC). Both target 501 and 502 show significant increases over a standard projectile.

Figure 6:
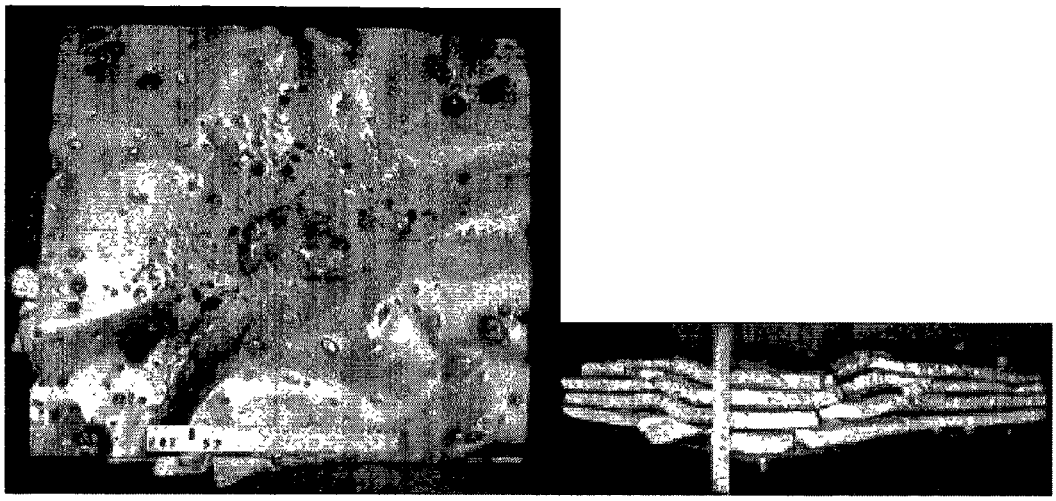
FIG. 6 is a set of photographs (6A-6B) of witness plates from a test using nano-enhanced projectiles of the current invention.
Figure 6:
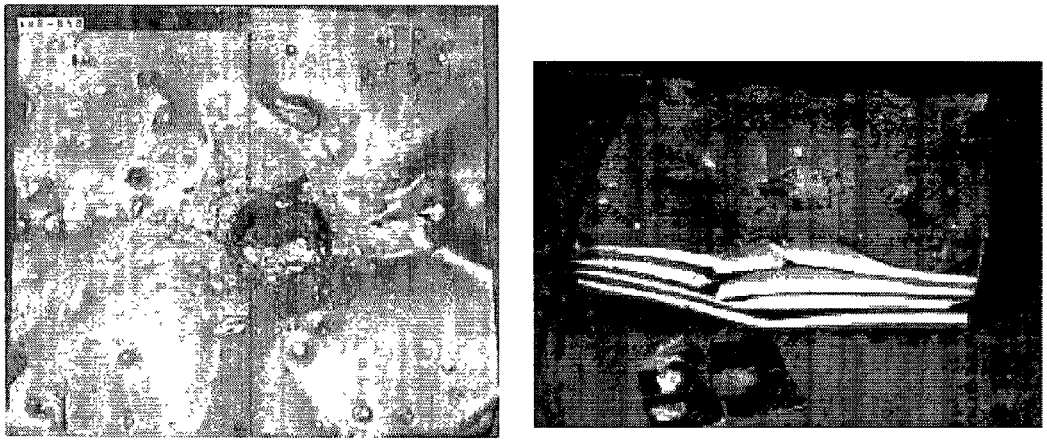

Additionally, all the witness plates shown in FIG. 6 show significant damage. FIGS. 6A and 6B are the frontal and side views, respectively, of the steel witness plates after penetration of the projectile with the inert material through the simulated armor. FIG. 6C are the frontal and side views, respectively, of the steel witness plates after penetration of the projectile with the MIC through the simulated armor. FIG. 6 reveals significant, explosive damage throughout the entire witness plate stack for both the MIC and inert material.

Figure 7:
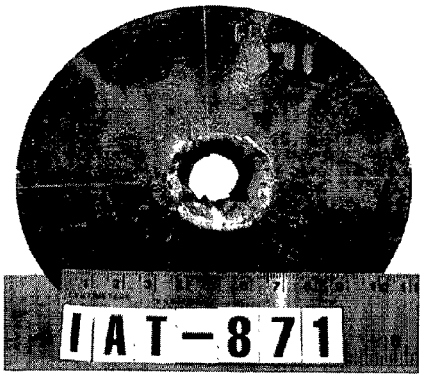
FIG. 7 is a set of photographs of target (7A and 7B) and witness plates (7C and 7D) from a test using a tungsten projectile of the present invention.
Figure 7:
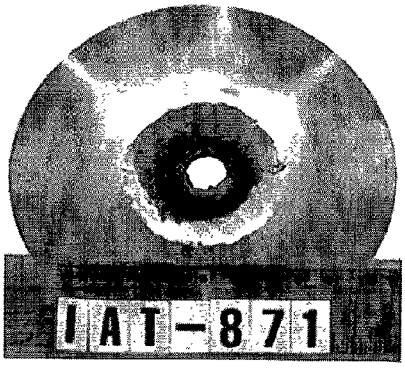
Figure 7:
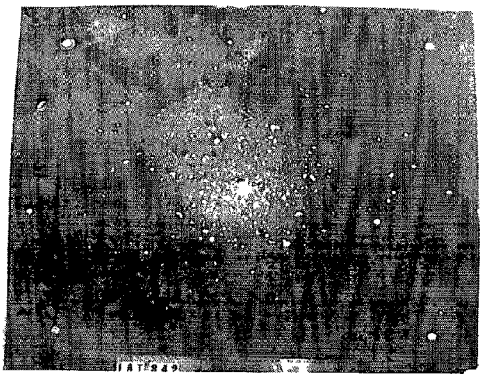
Figure 7:
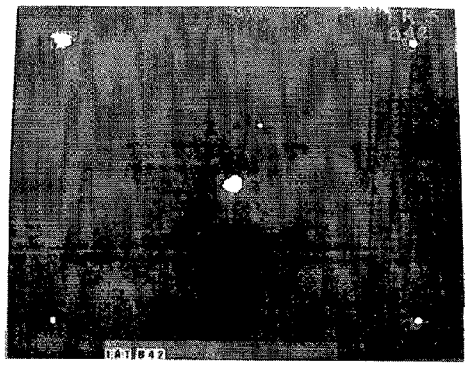

FIG. 7 shows the target 701 and witness plates 702 of a comparable diameter and weight solid tungsten projectile test fire at a similar velocity. FIGS. 7A and 7B show the front and rear view of the target 701; and FIGS. 7C and 7D show the front and rear view of the witness plates 702. FIG. 7 shows a clean small diameter hole through the target and also shows some damage to the front witness plate, but little damage to the back plate. A comparison of FIG. 7 with FIGS. 5 and 6 reflects that the hole and the damage to the witness plates shown in FIG. 7 appear to have less damage than the respective enhanced projectile test target and plates shown in FIGS. 5 and 6.

The amount of penetration and damage to the witness plates were unexpected results and shows a unique aspect of the current invention. While not intending to be bound by theory, it is believed that the increased performance takes advantage of several properties that are known to occur when a porous (heterogeneous) material is shock loaded.

The shock created by the impact results in complex shock wave interactions with the density discontinuities, which produces high-frequency, thermal fluctuations at the grain scale that can serve as hot-spots. Numerical simulations have shown that hot-spots are generated by (1) pore collapse (2) frictional heating at grain boundaries; (3) compression work of trapped gas; (4) plastic work; and (5) viscous heating in shear bands. The dominant dissipative mechanism depends on the material and the loading conditions. Another property associated with porous materials is a reduction of the speed of sound compared to the bulk homogeneous sound speed.

During the impact, kinetic energy is converted into internal energy at the penetrator/target interface. This conversion occurs at the interface because of the low sound speed of porous nanomaterial, in this case zirconia, which is less than the penetrator velocity. The increase in internal energy at the interface results in a significant temperature and pressure increase. For heterogeneous materials, the local pressures and temperatures are considerably higher than those that would occur for a homogeneous material due to the stress and temperature concentrations. In addition, there is a large decrease in phase change temperatures and enthalpies that are unique to nanoparticles. All of these effects lead to conditions that are favorable for evolving gas through thermodynamic phase change and/or heating the gas within the pores of the nanomaterial.

An additional mechanism, which a unique aspect to the nanoparticles is the fact that the thermal heating is a nonequilibrium process. The shock loading time scale is given by the particle diameter divided by the impact velocity, which is approximately 20 ps. The thermal relaxation time scale is comparable, resulting in a nonequilibrium heating. These effects can lead to an explosive vaporization of the nanoparticles and/or heating of the gas contained within the pores of the nanomaterial.

Figure 8:
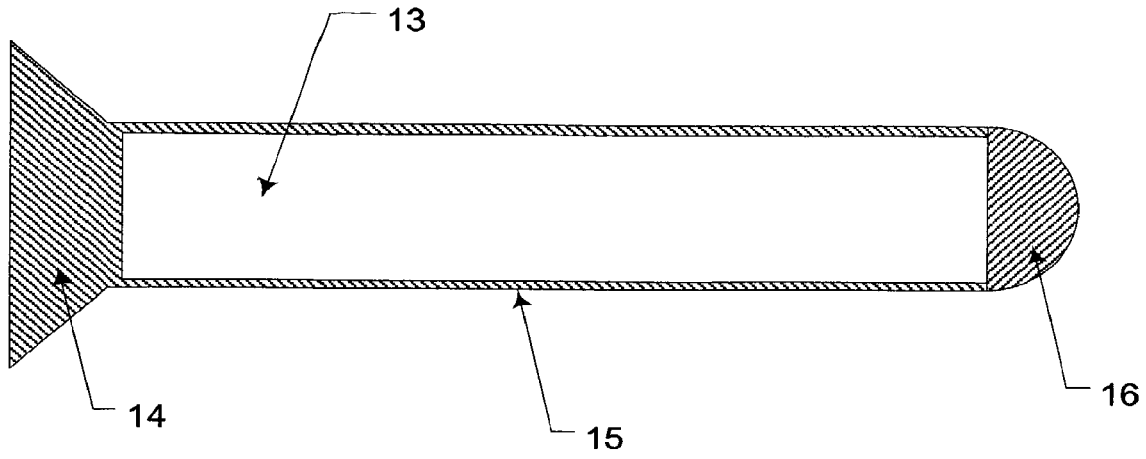
FIG. 8 illustrates an embodiment of the present invention with encapsulated nanomaterial.

FIG. 8 illustrates an embodiment in which the cups have been eliminated from the design. The embodiment includes a body 15, which can be optimally cylindrical, made from a high strength, high density material, such as, but not limited to steel, tungsten, depleted uranium, nickel, inconel, monel, tantalum, niobium and hafnium or a metal or a thermite pair such as aluminum or magnesium. The body 15 contains an interior cavity filled with material 13. The material 13 may be similar to the materials listed in the embodiment shown in FIG. 3. The material would be pressed directly into the body. Additionally, the material may be layered to segregate the reactive components such that they mix and react upon impact. Additionally, the material maybe that of oxidizer that reacts with the vaporized material of the projectile body or target upon impact or a metal that reacts with the projectile body or target upon impact. The material may be an inert nano-scale material that has a reduce enthalpy of vaporization relative to the bulk material such that it vaporized more readily upon impact. In all these cases, either chemical energy or additional work is delivered to the target. The ends of the projectile contain a stabilization flair 14 and an aerodynamic nose 16. In some cases, the stabilization flair is not required and a straight body with an aerodynamic nose can be used.

Figure 9:
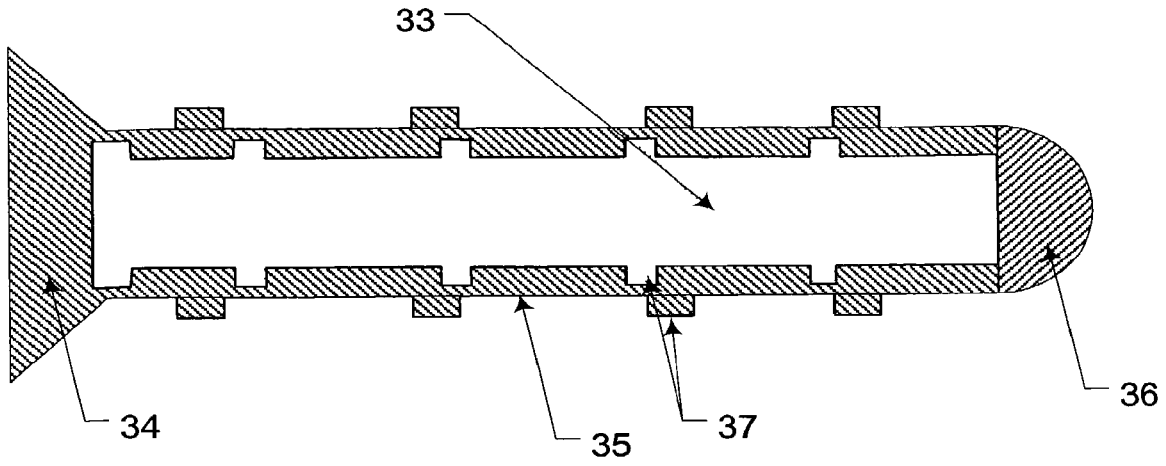
FIG. 9 illustrates an embodiment of the present invention with lands and grooves.

FIG. 9 illustrates another embodiment of the invention in which lands and grooves are used to help offset the setback load during the projectile launch. The projectile contains a body 35, which contains internal and or external lands and grooves, 37. The projectile contains a body 35, which can be optimally cylindrical, made from a high strength, high density material such as but not limited to steel, tungsten, depleted uranium, nickel, inconel, monel, tantalum, niobium and hafnium or a lighter material such as aluminum, magnesium or other metal of a thermite reaction pair. The exterior and interior of the body may contain lands and grooves 37. The exterior lands and grooves fit into respective lands and grooves in the ID of the sabot. The nanomaterial may be partially sintered or contain some binder to provide some structural integrity to the nanomaterial fill so that some of the setback load during launch can be distributed via the internal lands and grooves of the projectile body along the length of the projectile and reduces the chance of bucking of the body during launch. The material 33 may be similar to the materials listed in the embodiment shown in FIG. 3. The material may be pressed directly into the body and use the same configurations as mentioned in FIG. 8. The ends of the projectile contain a stabilization flair 34 and an aerodynamic nose 36. In some cases, the stabilization flair is not required and a straight body with an aerodynamic nose can be used.

A test was performed using an embodiment with the outside lands, as shown in FIG. 9. The inside of a smooth bore tungsten projectile was filled with bismuth oxide and launched into an aluminum target. The bismuth oxide showed clear signs of reacting with the target and showed 75% more crater volume per kinetic energy than an unfilled projectile.

Figure 10:
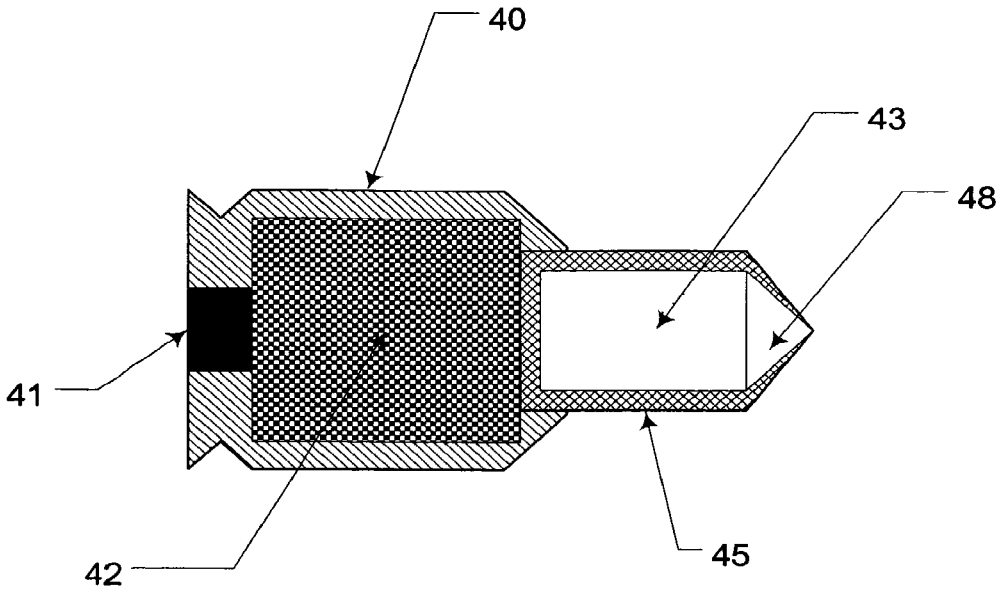
FIG. 10 illustrates an embodiment of the present invention with a ballistic bullet.

FIG. 10 shows a more common ballistic round or bullet used in conventional artillery, large caliber weapons, rifles, and handguns. While cased ammunition is pictured, it should be recognized that the projectile design could be used for non-cased ammunition and or non-saboted munitions, such as used in medium and major caliber gun weapon systems. The casing 40, as currently know in the state of the art contains a primer 41 and energetic powder 42 to propel or launch the projectile 45. The projectile 45 is sealed to the casing 40 such that when the primer is ignited, it in turn combusts the energetic powder 42 and launches the projectile 45 out the gun bore (not shown). The projectile 45 is made of materials commonly known in the state of the art such as lead, copper brass, tungsten, etc. and contains a cavity containing material 43. The material, 43, may be similar to the materials listed in the previous embodiments. The projectile 45 also contains a cap 48 that can, optionally, contain the material within the cavity. Upon impact with a target, the material within the projectile may vaporize, heat the gas with the pores and/or react such that it provides more efficient coupling of the kinetic energy and delivers chemical energy to the target such that additional damage occurs.

A range of projectiles were produced using an embodiment as shown in FIG. 10. All of the bullets were copper 0.270 caliber Barnes "X-Bullets" which were drilled out to a 0.191-in inner diameter and to a depth of 0.8-in. The cavity was then filled with various formulations of thermitic and inert material and then capped with a tungsten tip. Table 2 shows a list of the various formulation that were used, the filled density and the velocity at which they were fired from a 24-in rifled barrel.

TABLE 2

| Bullet Number | Projectile Fill Material | Fill Weight (g) | Fill Density (g/cc) | % of TMD (%) | Bullet Weight (g) | Powder Weight (grains) | Velocity (ft/sec) | Target |
|---|---|---|---|---|---|---|---|---|
| 3 | 1 micron $Bi_2O_3$ only | 1.78 | 5 | 56 | 8.24 | 54.3 | 2904 | ¼" mild steel |
| 4 | 1 micron $Bi_2O_3$ only | 2.12 | 5.9 | 66 | 8.65 | 54.3 | 2873 | ¼" mild steel |
| 5 | 1 micron $Bi_2O_3$ only | 2.13 | 5.9 | 66 | 8.65 | 54.3 | 2900 | ½" mild steel |
| 8 | 2 micron aluminum only | 0.68 | 1.9 | 70 | 7.18 | 57 | 3030 | ¼" mild steel |
| 9 | 2 micron Al (11 wt %) + 1 micron $Bi_2O_3$ | 1.73 | 4.8 | 68 | 8.21 | 54.3 | 2886 | ¼" mild steel |
| 10 | 2 micron Al (11 wt %) + 1 micron $Bi_2O_3$ | 1.72 | 4.8 | 68 | 8.2 | 54.3 | 2892 | ¼" mild steel |
| 11 | 2 micron Al (11 wt %) + 1 micron $Bi_2O_3$ | 1.73 | 4.8 | 68 | 8.26 | 54.3 | 2900 | ½" mild steel |
| 12 | 2 micron Al (11 wt %) + 1 micron $Bi_2O_3$ | 1.82 | 5.1 | 72 | 8.32 | 42.7 | 2359 | ¼" mild steel |
| 15 | 120 nm Al (15 wt %) + 1 micron $Bi_2O_3$ | 1.58 | 4.4 | 67 | 8.08 | 54.3 | 2900 | ¼" mild steel |
| 16 | 120 nm Al (15 wt %) + 1 micron $Bi_2O_3$ | 1.45 | 4 | 61 | 7.91 | 42 | 2171 | ¼" mild steel |
| 18 | 120 nm Al (15 wt %) + 1 micron $Bi_2O_3$ | 1.63 | 4.55 | 69 | 8.14 | 54.3 | 2824 | ¼" mild steel |
| 19 | 120 nm Al (15 wt %) + 1 micron $Bi_2O_3$ | 1.63 | 4.55 | 69 | 8.1 | 54.3 | 2900 | ½" mild steel |

The energetic formulation were prepared by separately mixing the aluminum and bismuth oxide in isopropyl alcohol (IPA) to allow a pourable solution, typically 70% loading for micron materials and 25% for nanomaterials. The two components were then weighed to give the required formulation and then blended. By mixing the two components wet, the sensitivity was greatly reduced. The bullets were filled with the blended formulation and pressed to the desired density using a porous plug at 30 ksi. The porous plug allowed the IPA to be forced out of the slurry to leave a dry compaction. To insure all the IPA was removed for the nanomaterial formulation, the die was heated to 220 F. The bullets were then capped with a pointed tungsten tip that was press fit into the bullet. The bullets were then loaded into the 0.270 cartridges charged with Hodgon H4350 smokeless powder.

The bullets were fired into a set-up containing a steel plate positioned perpendicular to the projectile's path with a second plated position approximately one foot behind the first plate but positioned at a 45 degree angle to direct the bullet downward. In all cases the bullets penetrated a first steel plate. In the tests, with the bullets containing the thermitic fill, a bright flash and thick smoke was observed between the two plates indicating that the energetic material was reacting upon impact.

There are significant aspects of the current embodiment. First, densities in excess of 5 gm/cc were obtained with the new material compared to most organic reactive materials that have densities in the range of 1-2 gm/cc. The higher density allows the bullet to have better penetration and more accuracy. Many of the current organic energetic materials use fillers to increase the density but this replaces the energetic material and reduces its effectiveness. Another significant advantage of the current embodiment over many organic energetic materials is that the material does not appear to detonate. If an energetic material detonates upon contact, then much of the blast occurs before the bullet penetrates the target and minimal behind armor damage occurs. With the current embodiment, the reaction rate is slower and occurs on the same order as the penetration rate, hence much of the chemical energy is delivered behind the armor to increase the amount of damage. And another significant aspect of the current embodiment is that the material did not react during launching of the projectile and the material reacted upon impact for relatively low velocities, approximately 2100 fps. A "low velocity" of the projectile is a velocity less than about 3,500 fps. Optimally, a low velocity embodiment travels at most 2,500 fps and more optimally at 2,000 fps.

In some embodiments of the invention, the powder is pressed into a compact. It may be possible to sinter the powder to form a more rigid compact. Because the sintering occurs at the nano-scale, the sintered compact would still retain much of the nano-scale properties. This allows the nanomaterial to provide some structural integrity and assists in offsetting the setback load during launch. Another method of ensuring good compaction of the powder in the long bores is to press the powder in multiple steps. This is accomplished by inserting material, pressing it, inserting more material, pressing it, etc. until the bore is filled. Additionally, the composition of the material may be varied along with the compaction density to tailor the desire results.

Being that the material can have significant porosity, the gas contained within the pores is yet another method of adjusting the amount of damage. It is theorized that some of the damage occurs because of the rapid heating of the gas within the material's pores associated with the rapid heating of the material. As this gas is heated, it will expand and perform pressure work or in other words damage. Adjusting the gas and/or gas properties, such as but not limited to density, thermal conductivity and specific heat can vary the contribution of this affect. For example, argon can be used when a low specific heat gas is required; also, for example, helium or hydrogen can be used when a lower density were required. Other gases include, but are not limited to, nitrogen, oxygen, combustible gases, hydrocarbons (methane, acetylene, etc), silane, neon, Freon, etc. The gas in the material fill may also be pressurized or contain multiple species. For the nanoscale compositions, these effects are enhanced due to the higher surface area of the powder. The higher surface area allows more gas to be in contact with the powder, hence it can transfer the energy quicker.

In embodiments of the invention, there are certain advantages that are or become apparent. One such advantage is that the incorporation of inert materials, and more preferably inert nanomaterial, provides an effective insensitive munition. Many of the current munitions use explosives to provide additional damage upon impact with the target. Such munitions have the disadvantage that they can accidentally discharge or, if hit with another explosive or projectile, they may discharge. This can cause considerable damage and loss of life. By using the invention of the present Application, there is the advantages of additional damage to the target that can be had without the use of dangerous explosives. Hence, embodiments of the present invention are effective insensitive munitions.

Another such advantage is that high-density materials can be used in place of the low-density explosives. This higher density of the materials utilized in embodiments of the present inventions means that a larger mass for the same size projectile can be launched. This equates to being able provide more kinetic energy to the target.

Another such advantage is that, in general, a particulate filled projectile will have a lower density than a solid projectile because there will be some porosity. However, the particulate filled projectile, has greater penetration than a solid projectile of identical mass and density and simultaneously has greater behind armor blast. This has several launch implications:

For an identical projectile size, the particulate filled projectile is generally a lower mass than a solid one. Thus, the sabot can also be lower mass, as it has to carry a smaller payload. This further reduces the mass of the launch package. This lower mass translates into higher velocity, and even greater lethality, for the package at a specific propellant mass. It also allows a conventional tank to launch a projectile closer to the hypervelocity regime, which is generally attainable only with electromagnetic launch weapons or missiles. It also reduces the time on target and potentially increases the shot rate, which are important in tank warfare as the typical tank battle has a duration of only about 2 minutes.

Alternatively, less propellant can be used to achieve the same projectile velocity. This means that less propellant and more launch packages can be stored in the tank, which is a volume limited system. Less onboard propellant effectively decreases the sensitivity of the munitions while increasing the magazine capacity of the tank.

Alternatively, if the projectile is increased in diameter to make it the same mass as a solid projectile, the sabot mass decreases as there is more surface area to couple the setback load. This decreases the parasitic mass of launch package and further increases lethality.

In general, depending upon the mission, lighter projectiles, higher velocity, or/and high shot rates can be achieved with identical or greater lethality.

Furthermore, since the particulate filled projectile has unexpectedly good penetration into hard targets and good coupling to soft targets means that the same projectile could be used for multiple missions. This means that fewer types of projectiles are needed onboard the tank, which reduces the logistics burden.

The above descriptions have been made by way of preferred examples, and are not to be taken as limiting the scope of the present invention. It should be appreciated by those of skill in the art that the methods and compositions disclosed in the examples merely represent exemplary embodiments of the present invention. However, those of skill in the art should, in light of the present disclosure, appreciate that many changes can be made in the specific embodiments described and still obtain a like or similar result without departing from the spirit and scope of the present invention.

What is claimed is:

1. A projectile comprising:

a metal oxide;

a metal body having an interior cavity for containing said metal oxide operable to react with said metal body upon an impact of said projectile with a target; and a stabilization flair connected to said metal body.

2. The projectile of claim 1, wherein said metal body is made of aluminum.

3. The projectile of claim 1, wherein said metal oxide is iron oxide.

* * * * *